US009450361B2

(12) United States Patent
Yeh

(10) Patent No.: US 9,450,361 B2
(45) Date of Patent: Sep. 20, 2016

(54) RETENTION MODULE WITH PROTECTION CAP

(71) Applicant: FOXCONN INTERCONNECT TECHNOLOGY LIMITED, Grand Cayman (KY)

(72) Inventor: Cheng-Chi Yeh, New Taipei (TW)

(73) Assignee: FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days.

(21) Appl. No.: 14/676,840

(22) Filed: Apr. 2, 2015

(65) Prior Publication Data

US 2015/0288117 A1 Oct. 8, 2015

(51) Int. Cl.
*H01R 31/00* (2006.01)
*H01R 12/70* (2011.01)
*H01R 12/72* (2011.01)

(52) U.S. Cl.
CPC ..... *H01R 31/00* (2013.01); *H01R 12/7023* (2013.01); *H01R 12/7052* (2013.01); *H01R 12/72* (2013.01)

(58) Field of Classification Search
CPC ..... H01R 31/00
USPC ..... 439/135, 940
See application file for complete search history.

(56) References Cited

U.S. PATENT DOCUMENTS 4,396,245 A * 8/1983 Lane ..... H01R 13/443 29/758
5,899,760 A * 5/1999 Ho ..... H01R 43/205 29/743
5,910,023 A * 6/1999 McHugh ..... H01R 43/205 439/41
6,015,305 A * 1/2000 McHugh ..... H01R 43/205 439/135
6,135,795 A * 10/2000 Ho ..... H01R 43/205 439/135
6,168,444 B1 * 1/2001 Wu ..... H01R 43/205 439/135
6,439,901 B1 * 8/2002 Ji ..... H01R 43/205 439/135
6,506,064 B1 * 1/2003 Wu ..... H01R 43/205 439/135
6,599,140 B1 * 7/2003 Chen ..... H01R 43/0263 439/135
6,783,369 B2 * 8/2004 Zhang ..... H05K 13/0408 439/135
6,945,799 B2 * 9/2005 Huang ..... H01R 13/516 439/135
6,971,890 B2 * 12/2005 Ma ..... H05K 7/1053 439/135
7,004,768 B2 * 2/2006 Ma ..... H05K 7/1061 439/135

(Continued)

FOREIGN PATENT DOCUMENTS

TW M358440 6/2009

*Primary Examiner* — Ross Gushi
(74) *Attorney, Agent, or Firm* — Wei Te Chung; Ming Chieh Chang

(57) ABSTRACT

A protection cap provided for a retention module of a photoelectric conversion connector assembly includes an upper wall, a plurality of supporting walls extending downwardly from the upper wall and at least one protruding portion extending downwardly from the upper wall. The protruding portion has a latch portion at a free end thereof for latching a retention plate of the retention module. The latch portion has a first inclined guiding face extending towards the free end so as to guide the retention plate to a printed circuit board.

20 Claims, 6 Drawing Sheets

(56) References Cited

U.S. PATENT DOCUMENTS 7,033,188 B2 * 4/2006 Ma ..... H05K 7/1061 439/135
7,056,145 B2 * 6/2006 Campbell, III .... H01R 13/6395 174/67
7,059,876 B2 * 6/2006 Zhang ..... H01R 43/205 439/135
7,070,428 B2 * 7/2006 Ma ..... H05K 3/303 439/135
7,090,517 B2 * 8/2006 Ma ..... H05K 7/1061 439/135
7,140,890 B1 * 11/2006 Ju ..... H01R 43/205 439/135
7,189,084 B2 * 3/2007 Iikura ..... H04M 1/0274 439/135
7,264,487 B2 * 9/2007 Liao ..... H01R 43/205 439/135
7,303,412 B1 * 12/2007 Liao ..... H01R 13/62 439/135
7,322,836 B2 * 1/2008 Shun ..... H01R 43/0263 439/135
7,367,822 B2 * 5/2008 Ma ..... H01R 23/72 439/135
7,393,219 B2 * 7/2008 Liao ..... H01R 13/5213 439/135
7,429,181 B2 * 9/2008 Liao ..... H05K 7/1007 439/135
7,442,043 B2 * 10/2008 Yuan ..... H01R 12/57 439/135
7,445,454 B2 * 11/2008 Szu ..... H01R 43/00 439/41
7,517,229 B2 * 4/2009 Ma ..... H05K 7/1061 439/331
7,527,507 B2 * 5/2009 Liao ..... H01R 13/447 439/135
7,530,822 B2 * 5/2009 Liao ..... H01R 43/205 439/135
7,534,114 B2 * 5/2009 Liao ..... H01R 13/5213 439/135
7,563,101 B2 * 7/2009 Liao ..... H05K 7/10 439/135
7,578,684 B2 * 8/2009 Liao ..... H05K 7/1053 439/135
7,621,751 B2 * 11/2009 Minich ..... H01R 43/26 439/41
7,628,615 B2 * 12/2009 Lin ..... H05K 7/1061 439/135
7,670,145 B2 * 3/2010 Cheng ..... H01R 12/712 439/41
7,749,002 B1 * 7/2010 Chiang ..... H01R 13/52 439/135
7,762,823 B2 * 7/2010 Zhang ..... H05K 7/1007 439/135
7,883,345 B2 * 2/2011 Yeh ..... H05K 7/10 439/135
7,946,865 B1 * 5/2011 Lai ..... H01R 43/205 439/135
8,142,201 B2 * 3/2012 Fan ..... H05K 7/1007 439/135
8,206,158 B2 * 6/2012 Hsu ..... H05K 7/1053 439/41
8,257,098 B2 * 9/2012 Yeh ..... H05K 7/1053 439/135
8,282,399 B2 * 10/2012 Saito ..... H05K 3/303 439/135
8,439,693 B2 * 5/2013 Yeh ..... H05K 7/1007 439/135
8,439,694 B2 * 5/2013 Yeh ..... H01R 12/88 439/135
8,529,275 B2 * 9/2013 Kagotani ..... H01R 43/0256 439/41
8,622,278 B1 * 1/2014 Alvarez ..... H05K 13/0465 228/212
8,747,120 B2 * 6/2014 Terhune, IV ..... H05K 7/1053 439/41
8,905,765 B2 * 12/2014 Yeh ..... H05K 7/00 439/331
8,998,623 B2 * 4/2015 Hsu ..... H05K 7/1053 439/70
8,998,625 B2 * 4/2015 Yeh ..... H01R 13/62 439/136
9,118,150 B2 * 8/2015 Hsu ..... H01R 12/707
9,131,613 B2 * 9/2015 Hsu ..... H05K 7/1007
9,223,100 B2 * 12/2015 Yeh ..... G02B 6/4228
2004/0166710 A1 * 8/2004 Ma ..... H01R 12/7058 439/135
2004/0171288 A1 * 9/2004 Banas ..... H01R 13/506 439/135
2004/0248442 A1 * 12/2004 Huang ..... H01R 13/516 439/135
2004/0266233 A1 * 12/2004 Huang ..... H01R 13/6273 439/135
2005/0003683 A1 * 1/2005 Liao ..... H01R 43/205 439/41
2005/0009377 A1 * 1/2005 Liao ..... H05K 7/1061 439/41
2005/0032397 A1 * 2/2005 Huang ..... H05K 7/1053 439/41
2005/0112922 A1 * 5/2005 Ma ..... H01R 13/453 439/135
2005/0130472 A1 * 6/2005 Hou ..... H01R 43/205 439/135
2005/0176280 A1 * 8/2005 Ma ..... H05K 13/0408 439/135
2006/0024982 A1 * 2/2006 Stone ..... H05K 7/1053 439/41
2006/0051992 A1 * 3/2006 Banas ..... H01R 13/506 439/135
2006/0094271 A1 * 5/2006 Zhang ..... H05K 13/0408 439/135
2007/0155205 A1 * 7/2007 Harper, Jr. ..... H01R 43/0242 439/135
2007/0155206 A1 * 7/2007 Fan ..... H01R 13/447 439/135
2007/0202718 A1 * 8/2007 Liao ..... H05K 7/1007 439/78
2008/0009158 A1 * 1/2008 Ma ..... H05K 7/1053 439/135
2008/0038938 A1 * 2/2008 Liao ..... H01R 13/5213 439/41
2008/0045048 A1 * 2/2008 Ma ..... H05K 7/1061 439/73
2008/0102651 A1 * 5/2008 Szu ..... H01R 43/00 439/41
2008/0102665 A1 * 5/2008 Fan ..... H01R 13/447 439/135
2008/0146044 A1 * 6/2008 Liao ..... H05K 7/1053 439/41
2008/0153330 A1 * 6/2008 Minich ..... H01R 43/26 439/135
2008/0160814 A1 * 7/2008 Howell ..... H05K 7/1061 439/331
2009/0053915 A1 * 2/2009 Liao ..... H05K 7/10 439/148
2009/0061652 A1 * 3/2009 Fan ..... H01R 13/6595 439/41
2009/0311882 A1 * 12/2009 Lin ..... H05K 7/1053 439/41
2011/0177709 A1 * 7/2011 Yeh ..... H05K 7/1053 439/342
2012/0052753 A1 * 3/2012 Kagotani ..... H01R 43/0256 439/892
2012/0142209 A1 * 6/2012 Yeh ..... H01R 12/88 439/345
2014/0235098 A1 * 8/2014 Hsu ..... H05K 7/1061 439/577
2015/0288117 A1 * 10/2015 Yeh ..... H01R 12/7023 439/299
2015/0309273 A1 * 10/2015 Yeh ..... G02B 6/4284 385/92
2015/0311635 A1 * 10/2015 Yeh ..... H01R 12/716 439/370

* cited by examiner

RETENTION MODULE WITH PROTECTION CAP

BACKGROUND OF THE INVENTION

1. Field of the Invention

The present invention generally relates to a retention module with a protection cap, and more particularly to a retention module being used for a photoelectric conversion connector assembly.

2. Description of Related Art

A photoelectric conversion connector is used for the transformation between optical signal and electrical signal from one to the other in a photoelectric module. The photoelectric conversion connector has a receptacle connector being installed on a printed circuit board and a retention plate disposed at one side of the receptacle connector. The printed circuit board has a plurality of holes into which protruding portions of the retention plates assembled into. In existed technology, the retention plate is directly taken to a printed circuit board by an absorb device and assembled on the printed circuit board by making the protruding portions align with the holes and be pressed down. It is always encountered that the protruding portions of the retention plate can't be accurately aligned to the holes of the printed circuit board by the absorb device which result in damage to the retention plate.

In view of the foregoing, a protection cap provided to prevent the retention plate from being damaged will be described hereinafter.

SUMMARY OF THE INVENTION

Accordingly, an object of the present invention is to provide a retention module which has a protection cap to protect a retention plate.

In order to achieve the object set forth, a protection cap comprises an upper wall, a plurality of supporting walls extending downwardly from the upper wall and at least one protruding portion extending downwardly from the upper wall. The protruding portion has a spear-like latch portion at a free end thereof for latching an external element. The latch portion has a first inclined guiding face extending towards the free end for guiding.

In order to achieve the object set forth, a retention module used to be mounted onto a printed circuit board comprises a retention plate and a protection cap covering the retention plate. The retention plate has a base portion and at least one drawing hole extending downwardly from the base portion. The protection cap has an upper wall and at least one protruding portion downwardly extending into the at least one drawing hole. The protruding portion has a spear-like latch portion at a free end thereof passing through the drawing hole so as to latch the retention plate.

Other objects, advantages and novel features of the invention will become more apparent from the following detailed description when taken in conjunction with the accompanying drawings.

DETAILED DESCRIPTION OF THE INVENTION

Reference will now be made in detail to the preferred embodiment of the present invention.

Figure 1:
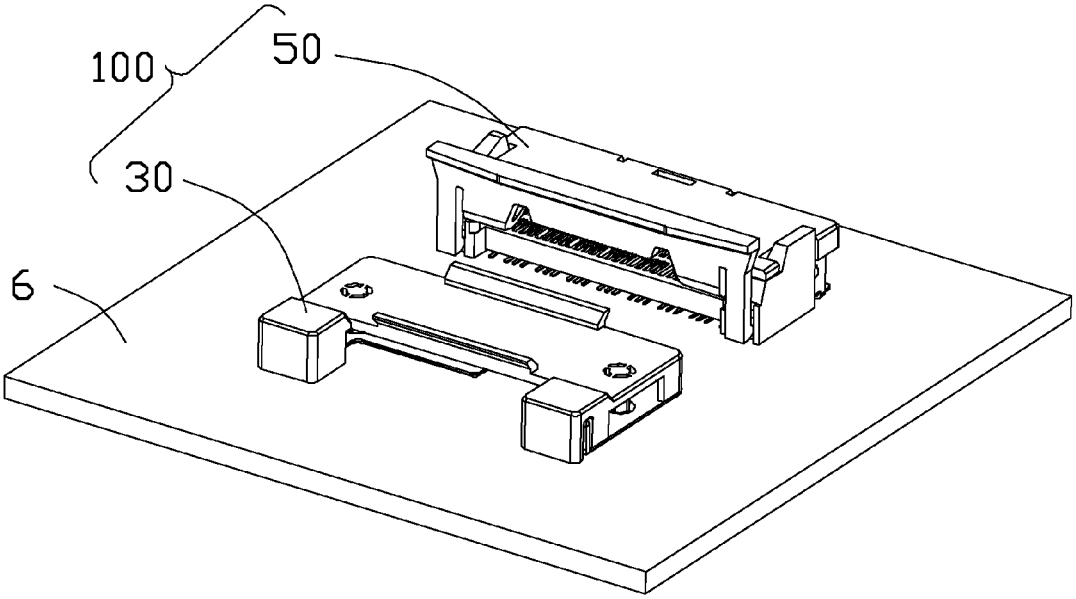
FIG. 1 is a perspective view of a photoelectric conversion connector assembly of the present invention.
Figure 2:
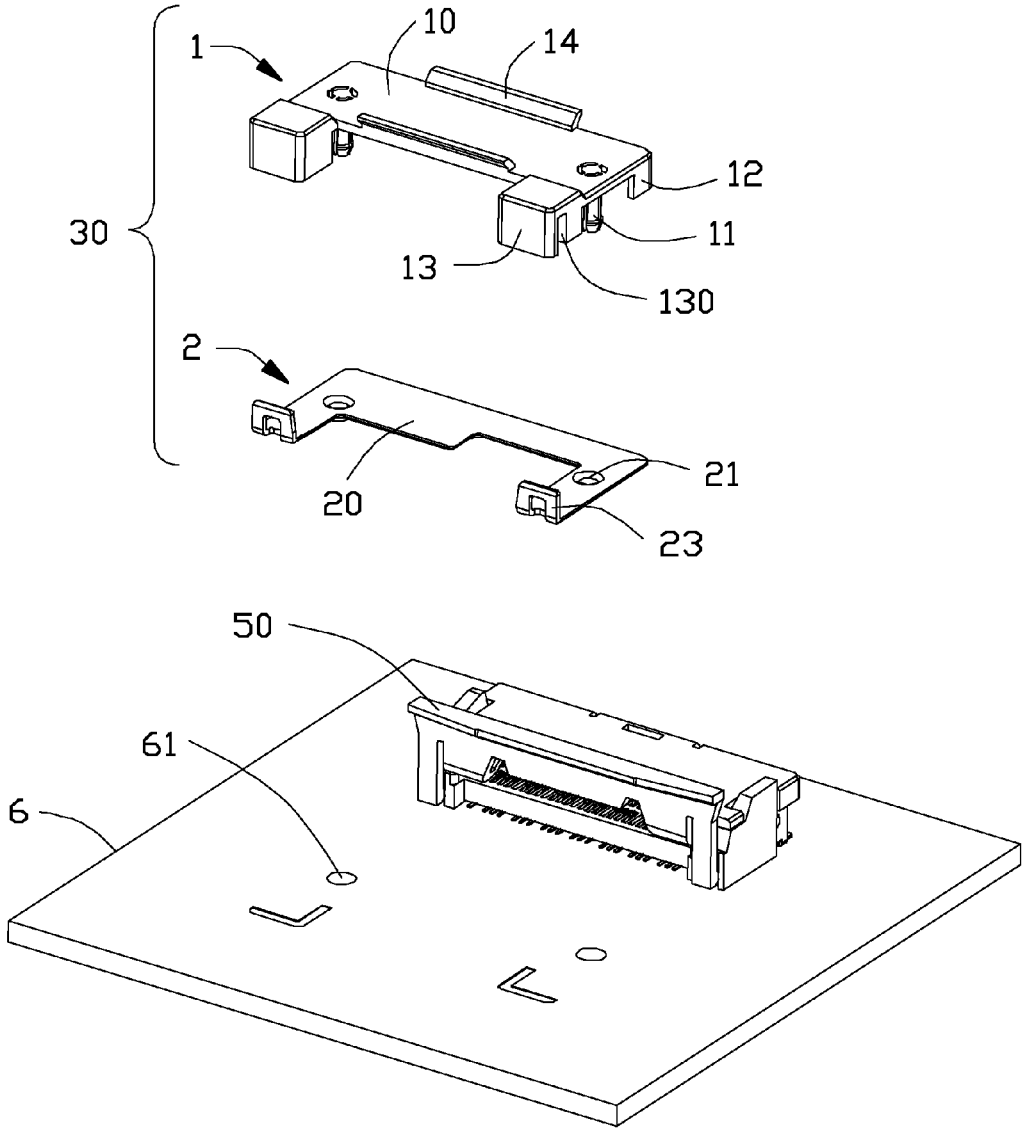
FIG. 2 is an exploded perspective view of the photoelectric conversion connector assembly in FIG. 1.

Referring to FIG. 1 and FIG. 2, the present invention provides a protection cap 1 being used for a photoelectric conversion connector assembly 100. The photoelectric conversion connector assembly 100 comprises a connector 50 mounted on a printed circuit board 6 and a retention module 30 disposed at a side of the connector 50. There is a certain distance between the connector 50 and the retention module 30. The retention module 30 has a retention plate 2 assembled on the printed circuit board 6 and a protection cap 1 covering the retention plate 2.

Figure 3:
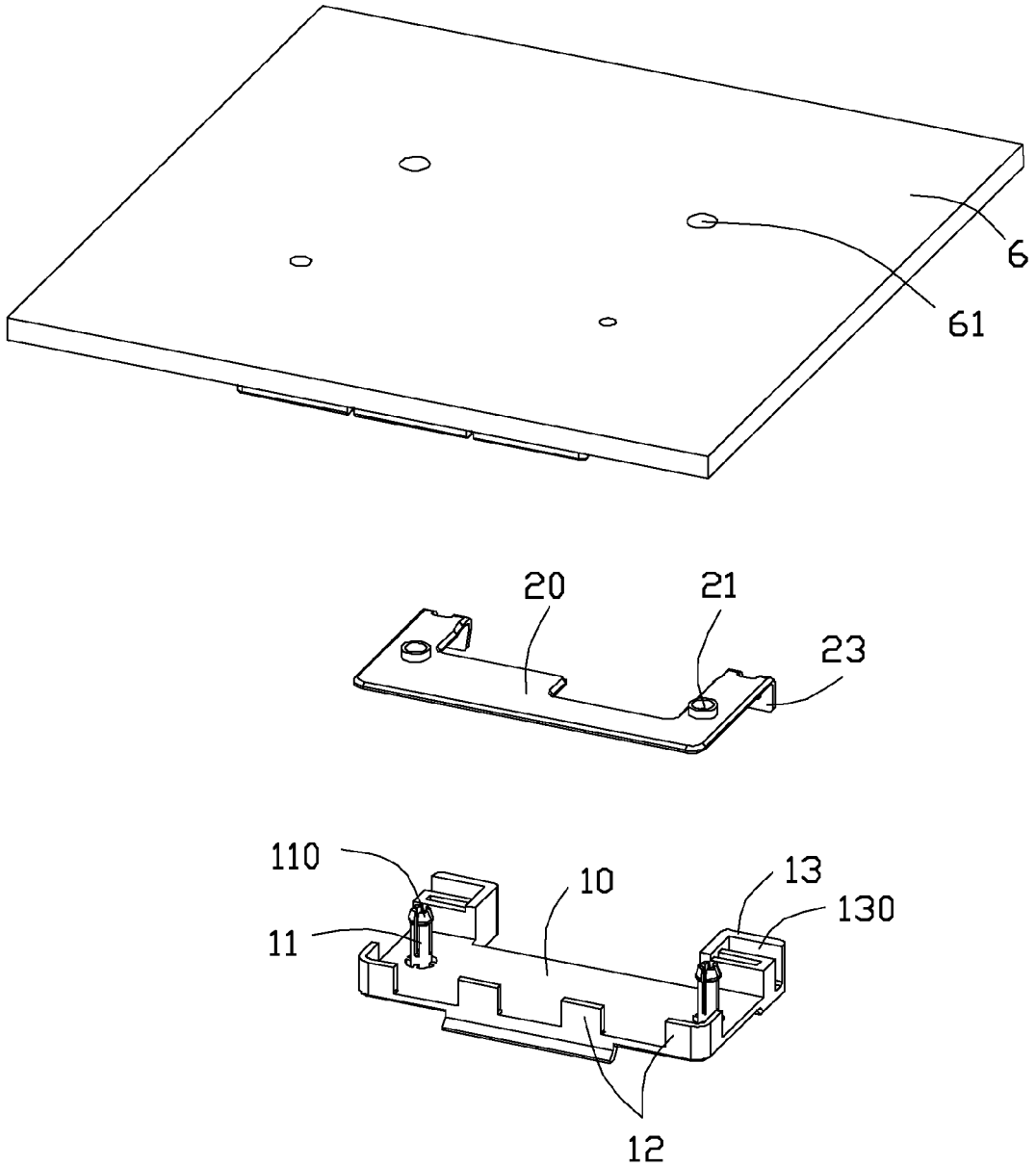
FIG. 3 is another exploded perspective view of the photoelectric conversion connector assembly in FIG. 1.

FIG. 2 and FIG. 3 will be taken to describe the protection cap 1 in detail hereinafter. The protection cap 1 has a tabulate upper wall 10 extending horizontally, a plurality of supporting walls 12 extending downwardly from the upper wall 10, two protruding portions 11 extending downwardly from the upper wall 10 and two inclined grab portions 14 extending upwardly and outwardly from edges of the upper wall 10. The supporting walls 12 are located at a peripheral area of a lower surface of the upper wall 10, the two protruding portions 11 are disposed at two ends of the lower surface of the upper wall 10 along a longitudinal direction and the two grab portions 14 are disposed at two opposite sides of an upper surface of the upper wall 10 and extend far away from each other. The protection cap 1 has two flanges 13 which extend forwardly from the supporting walls 12 and are disposed at two opposite sides with an interval space between them. The flange 13 is higher than the upper wall 10 and also can be a part of the supporting wall 12. The flange 13 each has a narrow receiving slot 130 running downwardly through a lower surface thereof and an outer side surface. The upper surface of the upper wall 10 is smooth so as to be easily absorbed by an absorb device. The two grab portions 14 extend towards two different orientations from two opposite side edges of the upper wall 10 so as to be convenient for taking the protection cap 1 off from the retention plate 2 by fingers.

Figure 4:
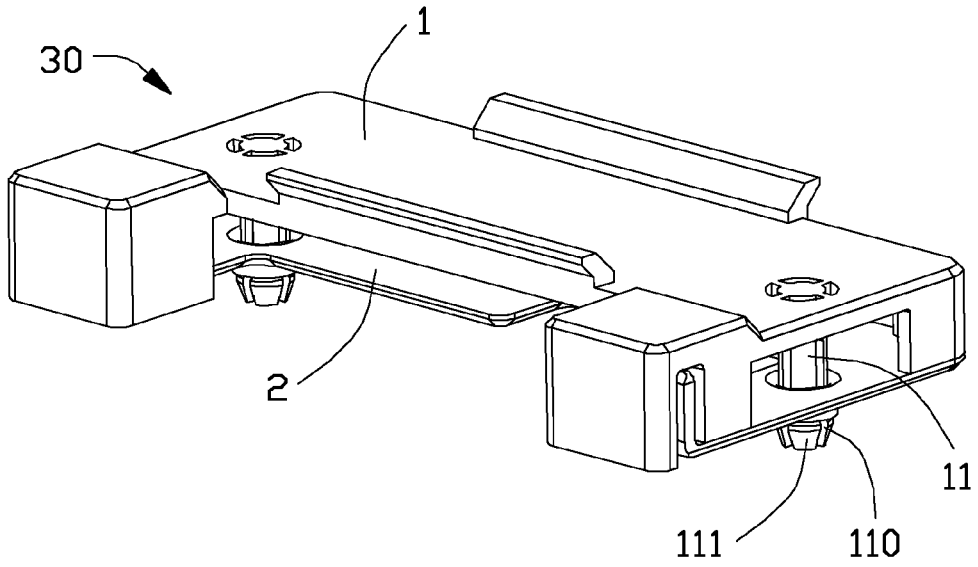
FIG. 4 is a perspective view of a retention module of the photoelectric conversion connector assembly shown in FIG. 1.
Figure 5:
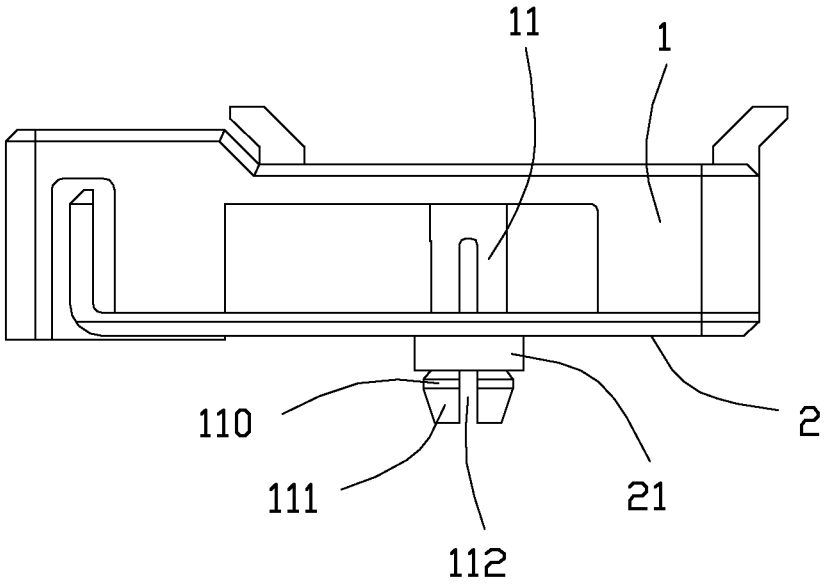
FIG. 5 is a right view of the retention module in FIG. 4.

Referring to FIG. 4 and FIG. 5, a bottom of the protruding portion 11 is lower than that of the supporting wall 12. The protruding portion 11 has a spear-like latch portion 110 at a free end thereof for cooperating with the retention plate 2. The latching portion 110 is located below a bottom surface of the supporting wall 12. A sectional size of the latch portion 110 is larger than the other part of the protruding portion 11 so as to latch with the retention plate 2 and retain the retention plate 2 and the protection cap 1 together. The latch portion or guiding head 110 has a first long inclined guiding face 111 extending towards the bottom end with a sectional size thereof downwardly and gradually reduced for easily assembling the retention plate 2 to the printed circuit board 6 and a second short inclined guiding face (not labeled) extending inwardly with a sectional size thereof upwardly and gradually reduced for being easily pulled out from the retention plate 2 by users. It means that the sectional size of the latch portion 110 between the first and the second inclined guiding faces is the largest than the other part of the protruding portion 11. The protruding portion 11 has a plurality of vertical narrow slots 112 so as to divide the protruding portion 11 into several pieces and make the protruding portion 11 have the property of elastic deformation. Thus, the retention module 30 having the protection cap 1 described aforementioned is convenient for automatic production.

The retention plate 2 is a metallic thin plate and has a flat base portion 20, two drawing holes 21 extending downwardly from the base portion 20 and two bending portions 23 unitarily bending upwardly from the base portion 20. The drawing holes 21 each forms a ring-like structure connecting with the base portion 20 of the retention plate 2. The drawing holes 21 of the retention plate 2 and the protruding portion 11 of the protection cap 1 are combined with each other and are together assembled to corresponding mounting holes 61 of the printed circuit board 6. In the meanwhile, the drawing hole 21 is received in the mounting hole 61 and the bending portions 23 are upwardly received in the receiving slots 130 of the flanges 13 of the protection cap 1.

Figure 6:
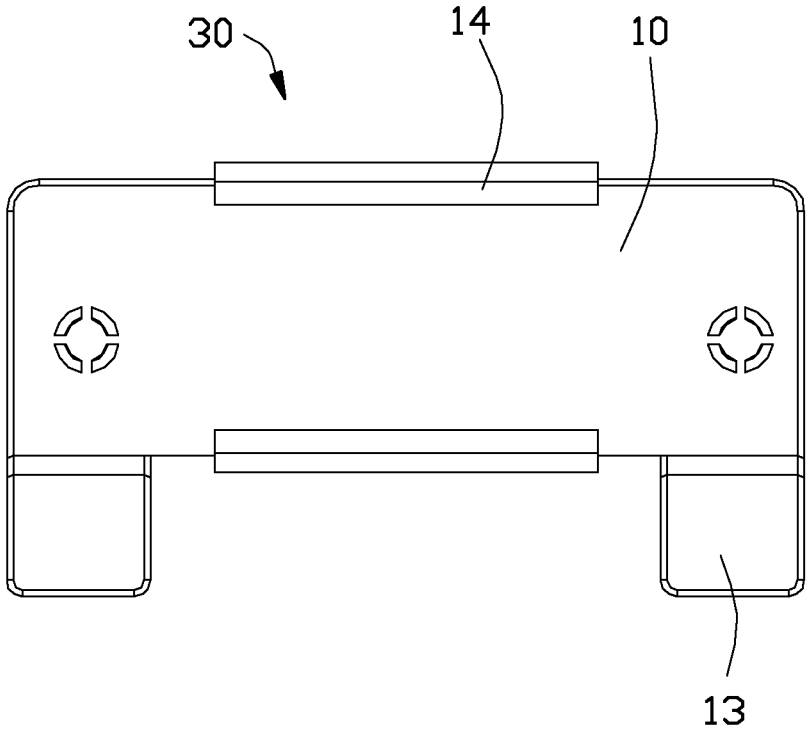
FIG. 6 is a top view of the retention module in FIG. 4.

In the assembling process, the protruding portions 11 of the protection cap 1 are assembled into the corresponding drawing holes 21 of the retention plate 2. The latch portion 110 of the protruding portion 11 latch with the drawing hole 21 of the retention plate 2 to assure the retention force between the protection cap 1 and the retention plate 2 to form a retention module, thereby the supporting walls 12 of the protection cap 1 press on an peripheral area of an upper surface of the base portion 20 of the retention plate 2 so as to disperse the pressure from external along a vertical direction, and the bending portions 23 of the retention plate 2 are received in the receiving slots 130 of the flanges 13 of the protection cap 1. Then the retention module is assembled to the printed circuit board 6 with the drawing holes 21 of the retention plate 2 and the protruding portions 11 of the protection cap 1 installed into the mounting holes 61 of the printed circuit board 6. In this condition, even though the drawing holes 21 of the retention plate 2 and the mounting holes 61 of the printed circuit board 6 have deviation between them, the first guiding face 111 of the latch portion 110 of the protruding portion 11 can guide the drawing hole 21 smoothly to slide into the mounting hole 61. Referring to FIG. 6, it is easily to see that the protection cap 1 is located above and entirely covers the retention plate 2, thereby the retention plate 2 will be prevent from being damaged by any external force after the assembly. The protection cap 1 is also easily pulled out by the users because of the features of the second guiding face (clearly shown in FIG. 5).

It is to be understood, however, that even though numerous characteristics and advantages of the present invention have been set forth in the foregoing description, together with details of the structure and function of the invention, the disclosure is illustrated only, and changes may be made in detail, especially in matters of shape, size, and arrangement of parts within the principles of the invention to the full extent indicated by the broad general meaning of the terms in which the appended claims are expressed.

I claim:

1. A protection cap comprising:

an upward upper wall for suction;

a plurality of supporting walls extending downwardly from the upper wall; and at least one protruding portion extending downwardly from the upper wall, the protruding portion having a guiding portion at a free end thereof for confronting a hole of a printed circuit board and guiding an external element to be mounted into said hole of the printed circuit board, the guiding portion having a first inclined guiding face extending towards the free end for guiding.

2. The protection cap as claimed in claim 1, wherein the protruding portion has at least one narrow slot extending downwardly therethrough along a vertical direction so as to provide a transformation space for the protruding portion when being pressed by an external force.

3. The protection cap as claimed in claim 1, wherein, the guiding portion directly contacts and cooperates with the printed circuit board when the external element is mounted to the printed circuit board.

4. The protection cap as claimed in claim 3, wherein the guiding portion is located within the hole of the printed circuit board when the external element is mounted to the printed circuit board.

5. The protection cap as claimed in claim 1, further comprising two flanges, the flange extends from the supporting walls and has a receiving slot running downwardly through lower surface thereof.

6. The protection cap as claimed in claim 1, wherein the guiding portion has a second inclined guiding face opposite to the first guiding face, the sectional size of the latch portion located between the first and second guiding faces is the largest and is also larger than that of the other part of the protruding portion.

7. The protection cap as claimed in claim 6, wherein the sectional size of the first guiding face is gradually reduced towards a free end direction, and the one of the second guiding face is gradually reduced towards an inner side direction, the first guiding face is longer than the second guiding face.

8. A retention module used to be mounted onto a printed circuit board comprising:

a retention plate having a base portion and at least one drawing hole extending downwardly from the base portion; and a protection cap covering the retention plate, the protection cap having an upper wall and at least one protruding portion downwardly extending into the at least one drawing hole, the protruding portion having a spear-like latch portion at a free end thereof passing through the drawing hole so as to latch the retention plate.

9. The retention module as claimed in claim 8, wherein the drawing hole forms a ring-like structure below and connecting with the base portion, the latch portion has a first inclined guiding face extending towards a free end thereof and beyond the ring-like structure for guiding.

10. The retention module as claimed in claim 9, wherein the latch portion has a second inclined guiding face opposite to the first inclined guiding face, the second inclined guiding face is shorter than the first inclined guiding face, the sectional size of the latch portion between the first and the second inclined guiding faces is the largest and is also larger than that of the other part of the protruding portion.

11. The retention module as claimed in claim 8, wherein the protection cap has a plurality of supporting walls extending downwardly from the upper wall, the supporting walls are set on the upper surface of the base portion of the retention plate, thereby the retention plate is retained between the supporting walls and the latch portion.

12. The retention module as claimed in claim 11, wherein the protruding portion has at least one vertical slot running through an outer side surface and a lower surface thereof, the latch portion is located below a bottom surface of the supporting walls.

13. The retention module as claimed in claim 8, wherein the retention plate has a pair of bending portion unitarily being bent upwardly from one side of the base portion thereof, the supporting walls define two corresponding flanges with two receiving slots receiving the corresponding bending portions.

14. The retention module as claimed in claim 8, wherein an upper surface of the upper wall is smooth, the protection cap has two opposite grab portions extending upwardly and outwardly from two opposite side edges of the upper wall, the two grab portions extend far away from each other.

15. The retention module as claimed in claim 8, wherein the protection cap entirely covers the retention plate taken from a top view.

16. A retention module assembly comprising:

a retention plate defining a drawing hole with a dimension adapted to be received within a through hole of a printed circuit board, said drawing hole forming a ring-like structure adapted to extend into the through hole; and a pick-up cap having a plate for suction, and a downward protruding portion with a guiding head at a bottom end, the protruding portion extending through the drawing hole and the guiding head extending downwardly beyond a bottom edge of the drawing hole; wherein the retention plate is detachably retained to and pick-up cap, and the guiding head is tapered with a tip end for easy insertion into the through hole of the printed circuit board to guide the ring-like structure of the drawing hole to move into the through hole.

17. The retention module assembly as claimed in claim 16, wherein the guiding head is diametrically shrinkable so as to retain the drawing hole in position temporarily in a coaxial manner.

18. The retention module assembly as claimed in claim 16, wherein the plate covers the retention plate in a vertical direction.

19. The retention module assembly as claimed in claim 16, wherein said retention plate further includes an upward bending portion, and the pick-cup cap includes a receiving slot to protectively receive said bending portion therein.

20. The retention module assembly as claimed in claim 16, wherein when the pick-up cap is assembled upon the retention plate, the guiding head is diametrically smaller than the ring-like structure of the drawing hole to extend through the ring-like structure.

* * * * *